United States Patent [19]

Swarden et al.

[11] 4,212,585

[45] Jul. 15, 1980

[54] CENTRIFUGAL COMPRESSOR

[75] Inventors: Michael C. Swarden, Cambridge, Mass.; Shankar S. Magge, Manchester, Conn.; Willem Jansen, Weston; Anthony F. Carter, Newton Highlands, both of Mass.

[73] Assignee: Northern Research and Engineering Corporation, Cambridge, Mass.

[21] Appl. No.: 870,871

[22] Filed: Jan. 20, 1978

[51] Int. Cl.[2] ..... F04D 29/44

[52] U.S. Cl. ..... 415/53 R; 415/206; 415/207; 415/219 C

[58] Field of Search ..... 415/53 R, 206, 207, 415/211, 213 R, 219 C, 170 A, DIG. 1

[56] References Cited

U.S. PATENT DOCUMENTS

| | | | |
|---|---|---|---|
| 1,663,998 | 3/1928 | Schmidt | 415/204 |
| 2,814,434 | 11/1957 | Boyd | 415/206 |
| 2,881,972 | 4/1959 | Feilden | 415/211 |
| 2,925,952 | 2/1960 | Garre | 415/219 A |
| 3,481,531 | 12/1969 | MacArthur et al. | 415/213 R |
| 3,893,787 | 7/1975 | Jones | 415/213 K |
| 4,063,848 | 12/1977 | Wiggins et al. | 415/211 |

FOREIGN PATENT DOCUMENTS 478957 10/1975 U.S.S.R. ..... 415/53 R

OTHER PUBLICATIONS

Wenzel, et al., "Effect of Casing Treatment on Performance of a Multistage Compressor", Jan., 1975; (NASA).

Takata, et al., "Study on the Mechanism of Stall Margin Improvement of Casing Treatment", Nov. 22, 1974; (ASME).

Horlock, et al., "Propagating Stall in Compressors with Porous Walls", Dec. 2, 1974; (ASME).

Fabri, et al., "Effect of Outer Casing Treatment and Tip Clearance on Stall Margin of a Supersonic Rotating Cascade", Dec. 2, 1974; (ASME).

Holman, et al., "Effects of Casing Treatment on a Small, Transonic Axial-Flow Compressor, Jul. 23, 1975; (ASME).

*Primary Examiner*—Louis J. Casaregola

[57] ABSTRACT

An improvement for extending the stable operating range of a centrifugal compressor comprises a circumferentially extending series of slots adjacent the leading edges of a series of compressor vanes such that there is relative motion between the series of slots and the vanes as the compressor impeller is driven in rotation.

17 Claims, 12 Drawing Figures

FIG 1
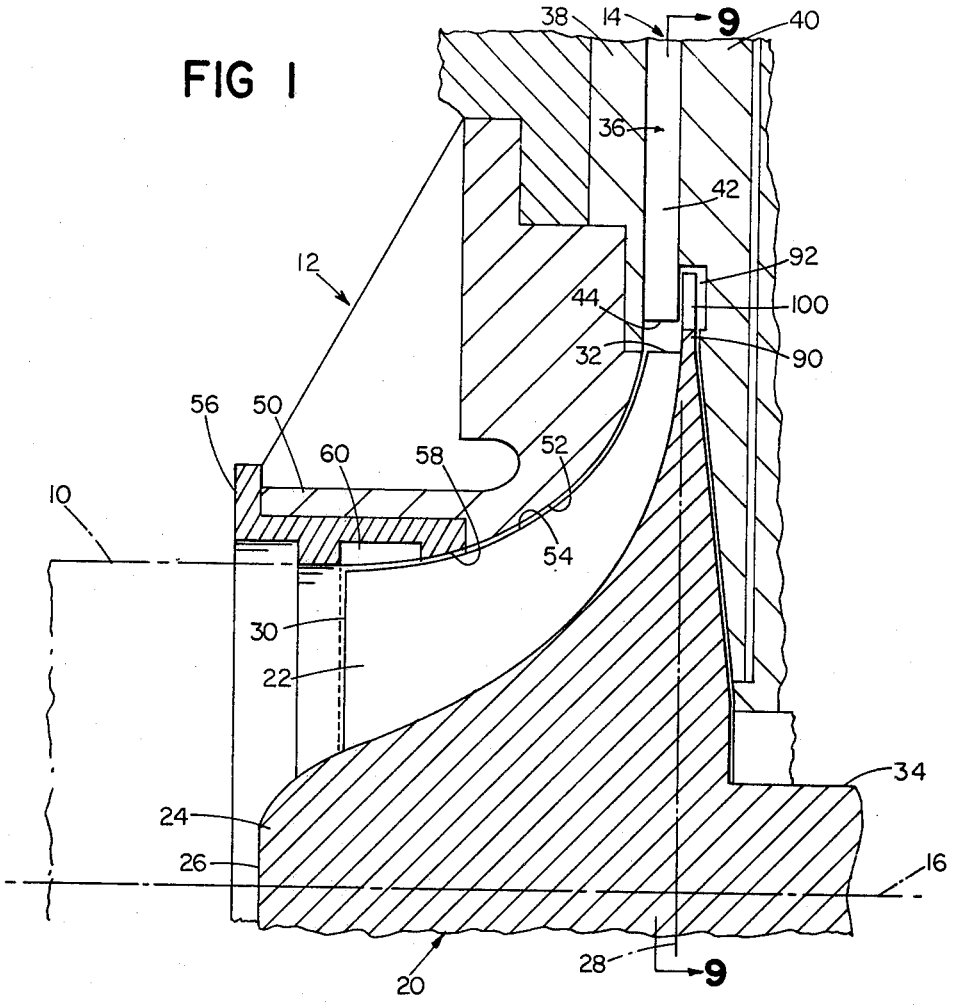
FIG 2
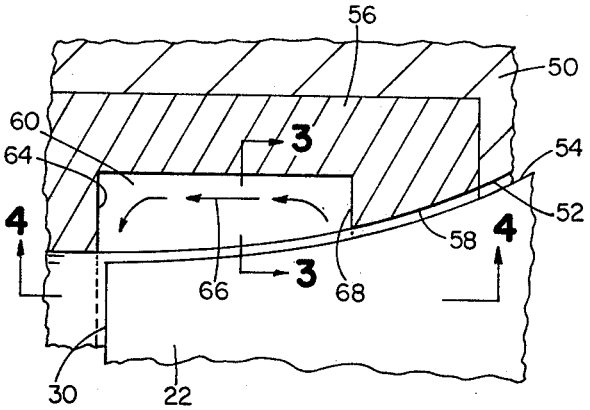
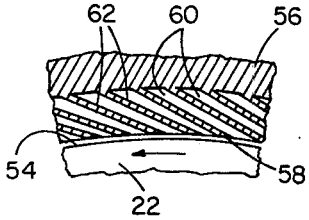
FIG 3
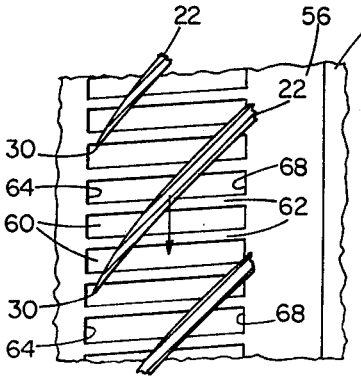
FIG 4

FIG 5
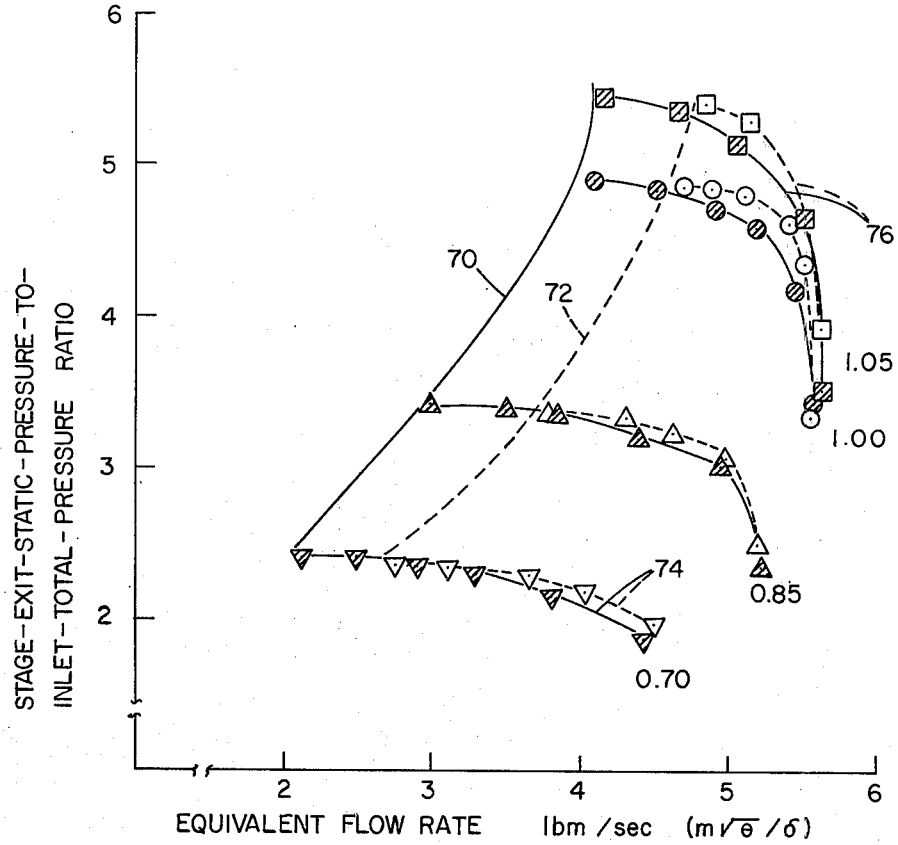
FIG 6
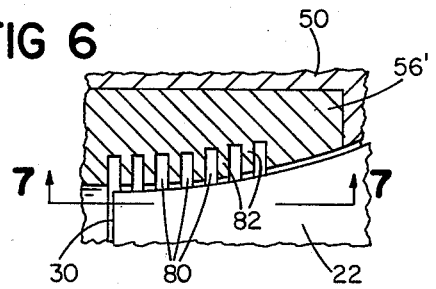
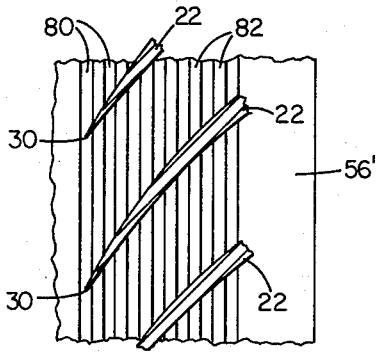
FIG 7
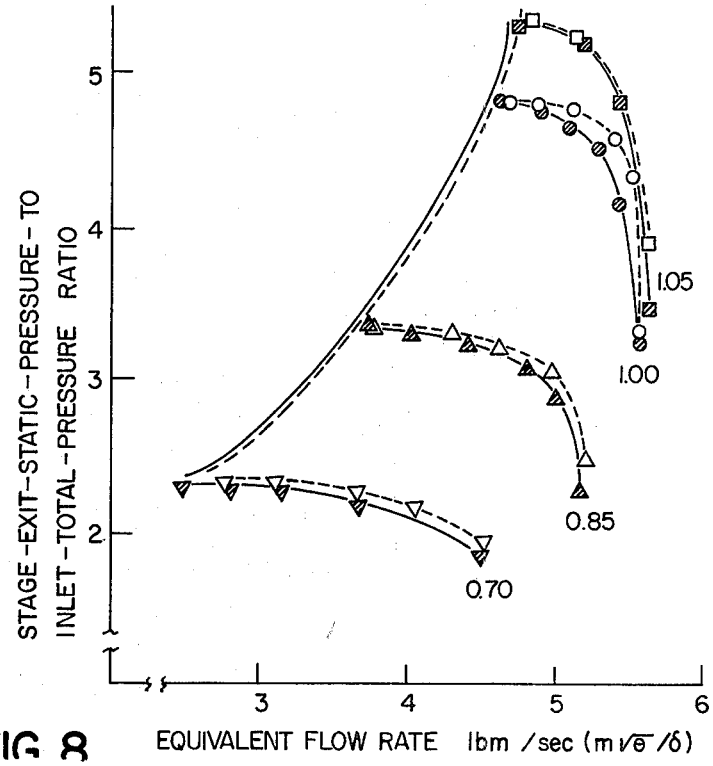
FIG 8

CENTRIFUGAL COMPRESSOR

This invention relates to centrifugal compressors and more particularly to arrangements which are particularly useful in extending the stable operating range of centrifugal compressors.

A centrifugal compressor includes a rotatably driven impeller disposed within a casing. The gas to be compressed flows through an intake port typically aligned with the impeller axis, and flows through along a gas flow path towards an annular, radially extending, diffuser passage. The impeller has a circumferentially arranged series of impeller vanes which rotate therewith, and the diffuser section typically has a circumferentially arranged series of fixed vanes, the leading edges of which are located in the gas flow path downstream from the trailing edges of the impeller vanes. The operating range of such centrifugal compressors is limited by an instability or "surge" condition which defines the lower end of the flow rate range of operation and a "choke" condition at the upper end of the flow rate range. It is an object of this invention to extend the stable operating range of centrifugal compressors.

In accordance with the invention there is provided a centrifugal compressor having casing structure in which an impeller is mounted for rotation about a compressor axis. The casing structure defines an inlet port generally aligned with the compressor axis and an annular outlet region that extends radially outwardly from the impeller. The impeller has a circumferentially arranged series of impeller vanes disposed in the gas flow path between the inlet and outlet passages and is arranged to receive gas from the inlet passage and to discharge gas centrifugally in a radially outward direction toward the outlet passage. Downstream in the gas flow path from the impeller is a diffuser section which includes a circumferentially arranged series of fixed vanes. The improvement comprises a circumferentially extending series of slots disposed adjacent the leading edges of at least one of the series of vanes such there is relative motion between the series of slots and that one series of vanes as the impeller is driven in rotation, which improvement extends the stable operating range of the centrifugal compressor. While gas flow characteristics in centrifugal compressors adjacent the leading edges of vanes are complex, and the function of the series of slots in accordance with the invention is not fully understood, it is believed that the slots allow recirculation of a portion of the gas being pressurized by the rotating impeller in an upstream direction for re-entry into the main flow path adjacent the leading edges of the adjacent vanes. Test data on centrifugal compressors in accordance with the invention indicates a significant improvement in surge margin with casing inducer treatment adjacent the leading edges of the impeller vanes, and improvement in both surge margin and choke characteristics with impeller rim and casing groove treatment adjacent the leading edges of the diffuser vanes.

In a particular centrifugal compressor embodiment, an insert carried by the shroud casing provides a series of slots adjacent the leading edges of the impeller vanes. The slots are circumferentially disposed about the impeller vanes and extend in an axial direction up to about ¼ of the meridional length of the gas flow path through the impeller. The slots are both skewed (at an angle of about 6°) relative to the compressor axis and radially slanted in the direction of impeller rotation. This compressor embodiment also includes impeller rim and casing groove treatment adjacent the leading edges of the diffuser vanes. A series of radially extending slots are formed in the peripheral rim of the impeller downstream from the trailing edges of the impeller vanes so that the series of slots is disposed circumferentially about the leading portions of the diffuser vanes. The walls of these slots are also inclined relative to the direction of impeller rotation. A circumferentially extending groove in the casing behind the series of impeller rim slots receives pressurized gas from the slots for recirculation upstream to a point adjacent the leading edges of the diffuser vanes.

This particular centrifugal compressor embodiment, with both inducer casing treatment and impeller rim treatment has marked improvement in operating range, both in terms of surge margin and choke characteristics. Advantages are obtained with the use of either type of casing treatment, however. It will be apparent that other slot configurations are also possible. For example, a casing insert with a series of circumferential slots adjacent the inlet portions of the impeller vanes has also been tested and found to provide a degree of operating range extension, although not as great as the improvement provided by the inducer casing treatment of the preferred embodiment. The circumferentially extending recirculation channel which communicates with the radially outward ends of axially extending slots may be employed in the inducer treatment.

Other features and advantages of the invention will be seen as the following description of particular embodiments progresses, in conjunction with the drawings, in which:

FIG. 1 is a diagrammatic view of a centrifugal compressor in accordance with the invention;

FIG. 2 is an enlarged view of the inducer casing treatment in the compressor shown in FIG. 1;

Figure 9:
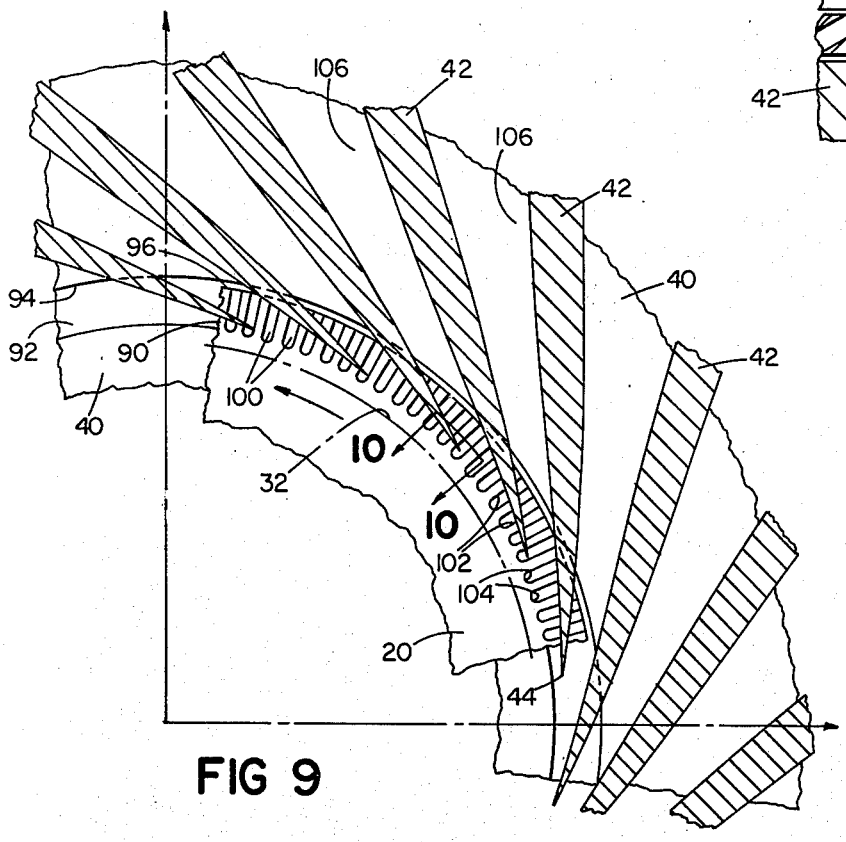
Figure 10:
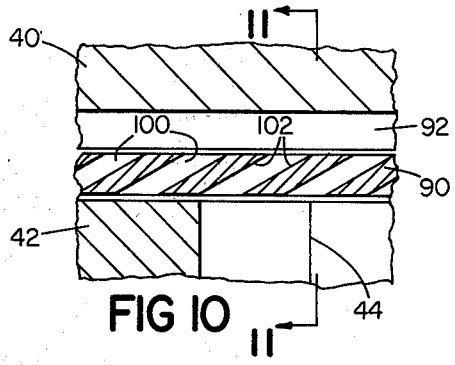
Figure 11:
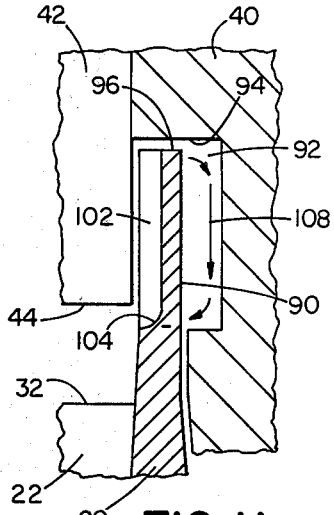
Figure 12:
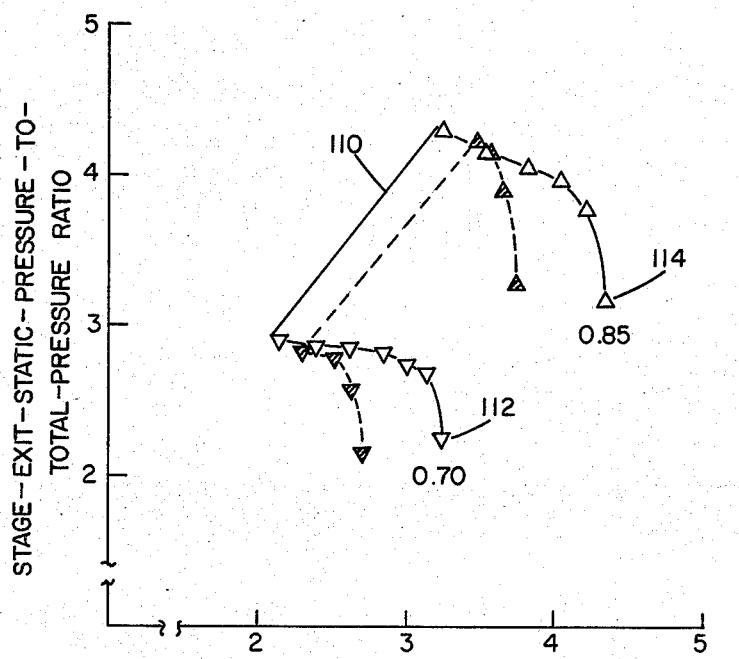

FIGS. 3 and 4 are diagrammatic sectional views taken along the lines 3—3 and 4—4, respectively of FIG. 2;

FIG. 5 is a graph showing operating range characteristics of a compressor with the inducer casing treatment shown in FIGS. 1-4;

FIG. 6 is a sectional view, similar to FIG. 2, showing a second form of inducer casing treatment;

FIG. 7 is a diagrammatic sectional view taken along the line 7—7 of FIG. 6;

FIG. 8 is a graph showing operating range characteristics of a compressor with the inducer casing treatment shown in FIGS. 6 and 7;

FIG. 9 is a diagrammatic section view of a portion of the compressor taken along the line 9—9 of FIG. 1;

FIG. 10 is a sectional view taken along the line 10—10 of FIG. 9;

FIG. 11 is a sectional view taken along the line 11—11 of FIG. 10; and FIG. 12 is a graph showing operating range characteristics of a compressor with inducer casing and impeller periphery treatments as shown in FIG. 1.

DESCRIPTION OF PARTICULAR EMBODIMENTS

With reference to FIG. 1, a centrifugal compressor, there diagrammatically shown, includes inlet 10 through which gas, typically air, enters for flow along a path within casing 12 and is directed centrifugally outwardly towards circumferential outlet passage 14 that is radially spaced from compressor axis 16. Disposed in casing 12 and mounted for rotation about axis 16 is impeller 20 which has a plurality of impeller vanes 22 serially arranged about the hub 24 in conventional manner. The impeller, in this embodiment, is of the high pressure ratio type with a design rotational speed of 39,000 r.p.m. and a design mass flow point of five pounds per second. Impeller hub 24 has an axial length of about ten centimeters from its forward surface 26 to reference plane 28, and a radius of about 3.3 centimeters at the leading edge 30 of the impeller vanes 22. The outer radial dimension of impeller vanes 22 at their leading edges 30 is about 7.5 centimeters and the radial dimension of the impeller vanes at their trailing edges 32 is about thirteen centimeters. Impeller 20 is driven in rotation in usual manner by its shaft 34.

Downstream from the trailing edges 32 of the impeller vanes 22 in the gas flow path is a diffuser section 36 in the form of a circumferential radially extending channel between shroud plate 38 and back plate 40. Disposed in the diffuser channel are a series of vanes 42 that have leading edges 44 adjacent but spaced from the trailing edges 32 of the impeller vanes.

The compressor casing 12 includes a shroud casting 50 that has an inner surface 52 corresponding to the outer surfaces 54 of impeller vanes 22 with a running clearance of about 0.5 millimeter. A cylindrical casing insert 56 is secured at the entrance end of the shroud casting 50 and has an inner surface 58 which forms a smooth extension of the inner surface 52 of shroud casting 50. Formed in surface 58 of casing insert 56 are a series of one hundred and eight slots 60 that are equally spaced about circumferential surface 58.

Further details of this casing treatment may be seen with reference to FIGS. 2–4. Each slot has an axial length of about two centimeters, a depth of about four millimeters (as viewed in FIG. 2) and a width of about 1.6 mm. Slot divider walls 62 have a width one half the slot width and are inclined at an angle of 60° to the radial direction and in the direction of impeller rotation as indicated in FIG. 3. Slots 60 are axially skewed, as indicated in FIG. 4 at an angle of about 6°. The leading edge 64 of each slot 60 is spaced about one millimeter upstream of the leading edges 30 of the impeller vanes 22.

While the flow near the leading edges of impeller vanes of centrifugal compressors is complex, and the function of slots 60 is not fully understood, it is believed that the slots allow recirculation (as indicated generally by line 66 in FIG. 2) from the downstream region of the slots adjacent following wall 68 towards the upstream region adjacent leading wall 64, a portion of the gas being pressurized by the rotating impeller vanes 22 spilling into slots 60 and flowing upstream and re-entering the inlet flow adjacent the leading edges 30 of the impeller vanes with interchange of fluid mass between the main stream and the pressurized recirculation streams from slots 60. Shown in FIG. 5 is performance data of a compressor stage with the skewed slot inducer casing treatment shown in FIGS. 1–4 (shaded data points) compared with a datum compressor stage without inducer casing treatment (outline data points). It will be seen that the surge margin of the compressor with skewed slot treatment (line 70) is markedly better than the surge margin (line 72) of the reference compressor stage over a range of impeller speeds from 70% design rotational speed (lines 74) to 105% design rotational speed (lines 76).

Another inducer casing treatment is shown in FIGS. 6 and 7. The treatment is formed in a casing insert 56' of the same shape as casing insert 56 shown in FIG. 1. That casing treatment includes a series of seven circumferential grooves 80 each about 0.15 centimeter wide and about 0.4 centimeter deep. The circumferential ribs 82 separating the grooves from one another are also each about 0.15 centimeter wide. The ratio of slot depth to vane height in this embodiment is about 0.1. Performance data of a compressor stage, with and without this inducer casing treatment, is shown in the graph of FIG. 8. The improvement in surge margin, as indicated in the Figure, is about 6%, an improvement which is markedly less than the improvement provided by the skewed slot casing treatment of FIGS. 2–4.

The compressor shown in FIG. 1 also has treatment at the radial periphery of impeller 20. Aspects of this treatment may be seen with reference to FIGS. 9–11. The impeller 20 has a circumferential rim portion 90 that has a radial length of about two centimeters and an axial width of about 0.3 centimeter. A circumferential groove 92 is formed in back plate 40 and disc 90 is disposed in that groove with the radial outer wall 94 of groove 92 being spaced about 0.5 millimeter from the peripherial edge 96 of disc 90 such that a circumferential chamber about 0.3 centimeter in axial dimension is defined behind rim 90. Formed in rim 90 are a series of one hundred and twenty slots 100. Each slot has parallel side walls 102 that, as indicated in FIG. 10, are inclined to the axis of rotation at an angle of 60°, a rounded base wall 104, and is about 1.4 centimeters in radial length and about one sixth centimeter in width. The leading edges 44 of diffuser vanes 42 are located radially outward (downstream) from the bases 104 of the slots 100, as indicated in FIG. 11, at a distance of about one-sixth centimeter.

The diffuser has twenty-three vanes 42 which are equally spaced to provide spaced diffuser channels 106 each with a divergence angle of about 10°. While the function of slots 100 is not fully understood, it is believed that the impeller rim and groove treatment imparts flow energy to the main stream as well as allowing recirculation (as indicated generally by line 108 in FIG. 11) from the downstream region adjacent impeller rim 96, a portion of the gas being pressurized by the rotating impeller slots 100 spilling into groove 92 and flowing upstream and re-entering the main flow path adjacent the leading edges 44 of the diffuser vanes.

Test data (outline data points) for the centrifugal compressor stage configuration shown in FIG. 1 at 70% design speed and 85% design speed are shown in FIG. 12 and compared with corresponding test data (shaded data points) on a datum compressor stage with a "shelf" diffuser of the same diffuser throat area. (The datum compressor stage had the same inducer casing treatment as shown in FIG. 1.) As indicated by that comparison data, the compressor stage with treatment at the impeller periphery has a significant improvement in its surge margin 110. Even more significant, is the improvement in choke characteristic as indicated by data points 112, 114. The compressor stage shown in FIG. 1, at 85% of design rotational speed, provided a four-to-one exit-to-inlet pressure ratio with peak efficiencies in excess of 75%.

Other embodiments will be apparent to those skilled in the art.

What is claimed is:

1. In a centrifugal compressor having casing structure defining inlet and outlet passages and a gas flow path between said passages, an impeller in said casing structure mounted for rotation about a compressor axis, said impeller having a circumferentially arranged series of impeller vanes in said gas flow path and arranged to receive gas from said inlet passage and to discharge gas centrifugally in a radially outward direction, and a diffuser section in said gas flow path downstream from said impeller, said diffuser section having a circumferentially arranged series of vanes in said gas flow path and extending in a radially outward direction through said diffuser section from said impeller towards said outlet passage, an improvement for extending the stable operating range of said centrifugal compressor comprising a circumferentially extending series of slots disposed at the periphery of said impeller adjacent the leading edges of the diffuser vanes, each said slot extending generally in the direction of said gas flow path, and said series of slots being disposed such that there is relative motion between said series of slots and said diffuser vanes as said impeller is driven in rotation.

2. The improvement according to claim 1 and further including a second circumferentially extending series of slots in said casing structure adjacent the leading edges of said impeller vanes.

3. The improvement according to claim 2 wherein each slot in said second series extends in an axial direction.

4. The improvement according to claim 3 wherein each slot in said second series is skewed at an angle to said axial direction.

5. The improvement according to claim 1 wherein each said slot has a length less than one quarter the meridional length of the gas flow path through said impeller.

6. The improvement according to claim 1 wherein said slots are equally spaced from one another.

7. The improvement according to claim 1 wherein the number of slots in said circumferentially extending series is at least twice the number of diffuser vanes.

8. The improvement according to claim 1 wherein the ratio of slot depth to vane height is less than 0.5.

9. The improvement according to claim 1 and further including a circumferentially extending chamber, said slots being open to said circumferentially extending chamber.

10. The improvement according to claim 1 wherein the walls of said slots are inclined in the direction of rotation of said impeller.

11. In a centrifugal compressor having casing structure defining inlet and outlet passages and a gas flow path between said passages, an impeller in said casing structure mounted for rotation about a compressor axis, said impeller having a circumferentially arranged series of impeller vanes in said gas flow path and arranged to receive gas from said inlet passage and to discharge gas centrifugally in a radially outward direction, and a diffuser section in said gas flow path downstream from said impeller, said diffuser section having a circumferentially arranged series of vanes in said gas flow path and extending in a radially outward direction through said diffuser section from said impeller towards said outlet passage, an improvement for extending the stable operating range of said centrifugal compressor comprising a circumferentially extending series of slots at the periphery of said impeller adjacent the leading edges of said diffuser vanes such that there is relative motion between said series of slots and said series of diffuser vanes as said impeller is driven in rotation, said series of slots extending in a radial direction with their walls skewed at an angle of at least 30° to the axis of rotation of said impeller and having a slot depth to vane height ratio of less than 0.5.

12. The improvement according to claim 11 and further including a circumferentially extending recirculation passage in communication with said slots on the side of said slots remote from said one series of vanes.

13. In a centrifugal compressor having casing structure defining inlet and outlet passages and a gas flow path between said passages, an impeller in said casing structure mounted for rotation about a compressor axis, said impeller having a circumferentially arranged series of impeller vanes in said gas flow path and arranged to receive gas from said inlet passage and to discharge gas centrifugally in a radially outward direction, and a diffuser section in said gas flow path downstream from said impeller, said diffuser section having a circumferentially arranged series of venes in said gas flow path and extending in a radially outward direction through said diffuser section from said impeller towards said outlet passage, an improvement for extending the stable operating range of said centrifugal compressor comprising a first circumferentially extending series of slots in said casing structure adjacent the leading edges of said impeller vanes and a second circumferentially extending series of slots disposed at the periphery of said impeller adjacent the leading edges of said diffuser vanes, each said slot extending generally in the direction of said gas flow path such that there is relative motion between each series of slots and the adjacent set of vanes as said impeller is driven in rotation.

14. The improvement according to claim 13 wherein said vanes in each said series overlie a substantial portion of the length of said slots along said gas flow path.

15. The improvement according to claim 14 wherein the leading edge of each slot is upstream of the leading edges of the adjacent set of vanes and each vane overlies at least fifty percent of the length of said slots along said gas flow path.

16. The improvement according to claim 15 where said slots are equally spaced from one another with a slot depth to vane height ratio in the range of 0.05–0.2, each said slot has a length less than one quarter the meridional length of the gas flow path through said impeller, and the number of slots in each circumferentially extending series is at least twice the number of vanes in the adjacent series.

17. The improvement according to claim 13 wherein walls of each slot are slanted relative to the gas flow direction adjacent said slot in the direction of rotation of said impeller.

* * * * *